US011286090B2

(12) United States Patent
Peng

(10) Patent No.: US 11,286,090 B2
(45) Date of Patent: Mar. 29, 2022

(54) BOTTLE CAP

(71) Applicant: Pandian Peng, Shenzhen (CN)

(72) Inventor: Pandian Peng, Shenzhen (CN)

( * ) Notice: Subject to any disclaimer, the term of this patent is extended or adjusted under 35 U.S.C. 154(b) by 0 days.

(21) Appl. No.: 16/907,790

(22) Filed: Jun. 22, 2020

(65) Prior Publication Data

US 2021/0047091 A1 Feb. 18, 2021

(51) Int. Cl.
*B65D 51/24* (2006.01)
*B65D 41/04* (2006.01)

(52) U.S. Cl.
CPC ..... *B65D 51/245* (2013.01); *B65D 41/0407* (2013.01); *B65D 41/0442* (2013.01)

(58) Field of Classification Search
CPC ..... B65D 51/245; B65D 41/0407; B65D 41/0442; A61J 7/04; A61J 1/03
See application file for complete search history.

(56) References Cited

U.S. PATENT DOCUMENTS

| | | | | |
|---|---|---|---|---|
| 6,059,133 | A * | 5/2000 | Lai | B65D 51/245 116/309 |
| 6,311,840 | B1 * | 11/2001 | Shrader | B65D 25/20 206/459.1 |
| 8,292,101 | B1 * | 10/2012 | Bragg | B65D 47/0838 215/237 |
| 2006/0180566 | A1 * | 8/2006 | Mataya | A61J 7/04 215/230 |
| 2008/0202950 | A1 * | 8/2008 | Anderson | B65D 51/2842 206/219 |
| 2013/0062351 | A1 * | 3/2013 | Meyers | B65D 47/0871 220/324 |
| 2013/0220967 | A1 * | 8/2013 | Wang | B65D 47/0838 215/253 |
| 2014/0332494 | A1 * | 11/2014 | Balakier | B65D 51/245 215/365 |
| 2017/0225834 | A1 * | 8/2017 | Peng | B65D 23/14 |
| 2017/0267393 | A1 * | 9/2017 | Peng | B65D 1/023 |
| 2017/0297784 | A1 * | 10/2017 | Peng | B65D 47/06 |
| 2018/0178955 | A1 * | 6/2018 | West | B65D 51/245 |

* cited by examiner

*Primary Examiner* — Shawn M Braden

(57) ABSTRACT

A bottle cap mechanism comprising a bottle cap body and a label ring that is locked inside the bottle cap body, wherein the bottle cap body includes an outer wall layer and an inner wall layer inside the outer wall layer, wherein the label ring card fits into the inner space formed by the outer wall layer and the inner wall layer; at least one label hole for exposing label information is provided on the outer wall layer.

9 Claims, 3 Drawing Sheets

BOTTLE CAP

TECHNICAL FIELD OF THE INVENTION

The utility model relates to the technical field of bottle cap products and components, in particular to a bottle cap mechanism with a reasonable structural design and outstanding application effects.

BACKGROUND OF THE INVENTION

The split bottle is a common product in people's daily life. It usually has special identification information to distinguish the content. However, the current split bottle is classified by attaching a label on the outside of the bottle, which is not convenient to use. And it is difficult to form universality between the separate bottling bottles, which is not conducive to the better promotion and application of the product.

So in order to better improve the use performance, there are currently structural improvements on the market for the bottle cap part to distinguish the information, but the effect is not good and the experience is not high.

Based on this, those skilled in the art have carried out a lot of research and development and experiments, starting from the specific structural part of the bottle cap part to improve it, and have achieved good results.

SUMMARY OF THE INVENTION

In order to overcome the problems existing in the prior art, the present invention is a bottle cap mechanism with reasonable structure design and outstanding application effect. The solution to the technical problem of the present utility model is to provide a bottle cap mechanism, which includes a bottle cap body and a label ring that is snapped into the inside of the bottle cap body; the bottle cap body includes an outer wall layer and an inner wall located inside the outer wall layer; the label ring snaps into an internal space formed by the outer wall layer and the inner wall layer; at least one label through-hole for exposing label information is opened on the outer wall layer In one preferred embodiment, a plurality of limiting grooves are annularly formed at the bottom of the inner wall layer, and a plurality of limiting blocks matched with the limiting grooves are integrally formed on the inner bottom of the label ring; the label ring is then snapped in. When inside the bottle cap main body, the limiting block is embedded in a corresponding limiting groove to form a sealed connection.

In another preferred embodiment, the inner space of the outer wall layer and the inner wall layer gradually decreases in width from the entrance to the interior of the space, and has a predetermined taper structure.

In another preferred embodiment, one end of the bottle cap body is further connected with a bottle cap that can be placed on the upper part of the bottle cap body.

In another preferred embodiment, the bottle cap extends outwardly to form a duck tongue-shaped protrusion for opening the bottle cap.

In another preferred embodiment, the outer wall of the bottom of the label ring and the outer wall of the cap body are flush with each other.

In another preferred embodiment, a sealing column is integrally formed on the upper part of the bottle cap main body, and a sealing ring matched with the sealing column is integrally formed at an intermediate part of the inside of the bottle cap; when the bottle cap is closed, the sealing ring is sleeved Into the outside of the sealing column.

In another preferred embodiment, the label through-hole is elongated; and two sides of the label-like through-hole are arc-shaped.

In another preferred embodiment, a thread groove is provided on the inner side of the bottle cap body In another preferred embodiment, a shrinking groove for elastic shrinkage is also formed in the inner side of the bottle cap body.

Compared with the prior art, the bottle cap mechanism of the present utility model is provided with a bottle cap main body 11 and a label ring 13 structure that is locked inside the bottle cap main body 11. The bottle cap main body 11 includes an outer wall layer 112 and The inner wall layer 113 on the inner side of the outer wall layer 112, during actual use, the tag ring 13 is snapped into the inner space formed by the outer wall layer 112 and the inner wall layer 113. The outer wall of the tag ring 13 is attached with a label. The outer wall layer 112 is provided with at least one label through hole 111 for exposing the label information, so as to achieve the effect of displaying the label information. The structure design of the outer wall layer 112 and the inner wall layer 113 of the present design facilitates the insertion of the label ring 13, High firmness, easy to change labels, and high reliability in structural design.

BRIEF DESCRIPTION OF THE DRAWINGS

To clearly expound the technical solution of the present invention, the drawings and embodiments are hereinafter combined to illustrate the present invention. Obviously, the drawings are merely some embodiments of the present invention and those skilled in the art can associate themselves with other drawings without paying creative labor.

DETAILED DESCRIPTION OF THE INVENTION

In order to make the purpose, technical scheme and advantages of the present invention clearer, the present invention will be further described in detail below with reference to the drawings and embodiments. It should be understood that the specific embodiments described herein are only used to explain the present invention, and are not used to limit the present invention.

Figure 1:
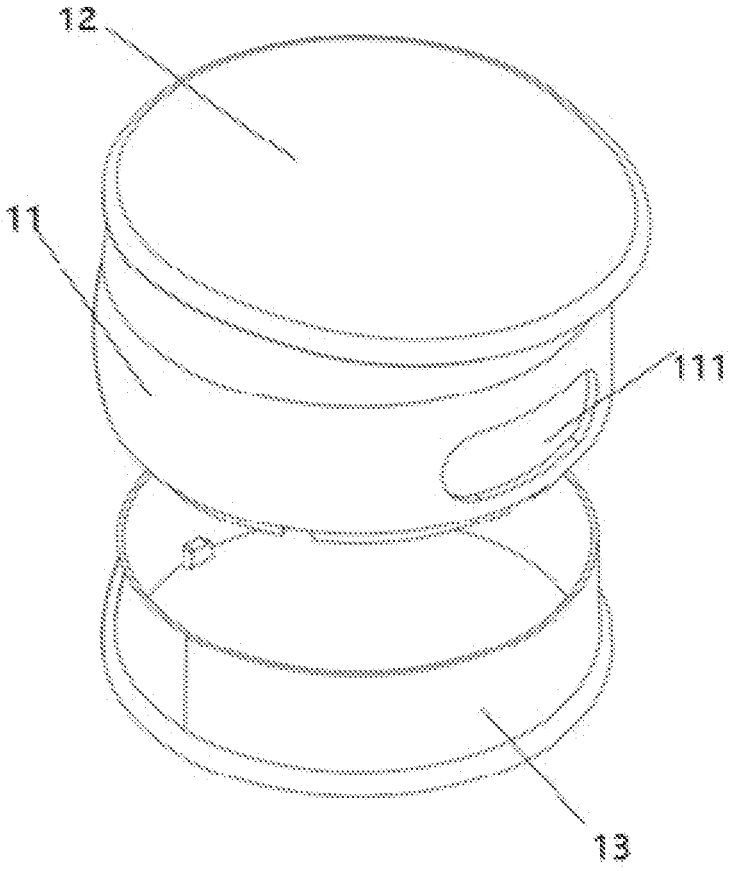
FIGS. 1 and 2 are schematic structural diagrams of an explosion state of a bottle cap mechanism according to the present invention.
Figure 2:
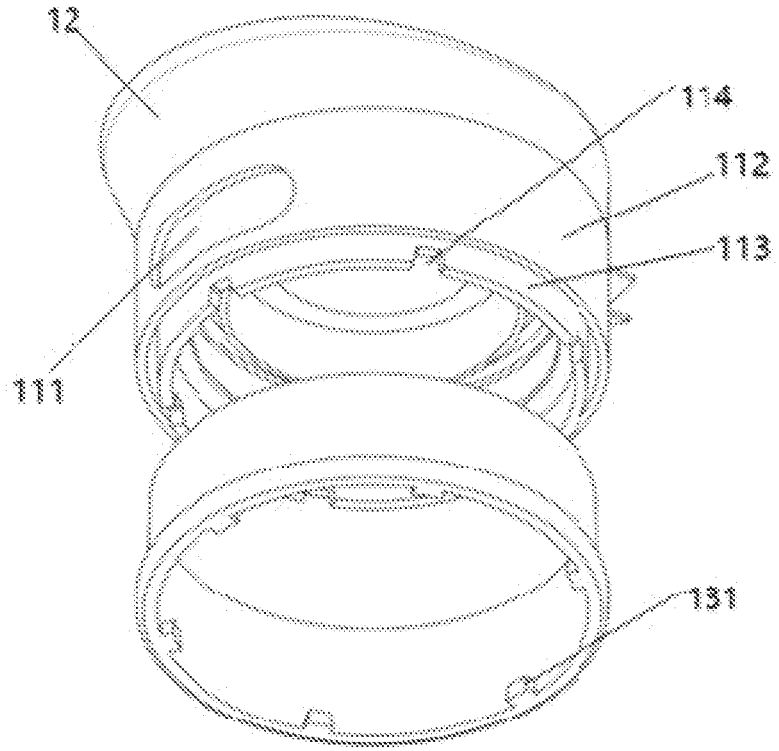
Figure 3:
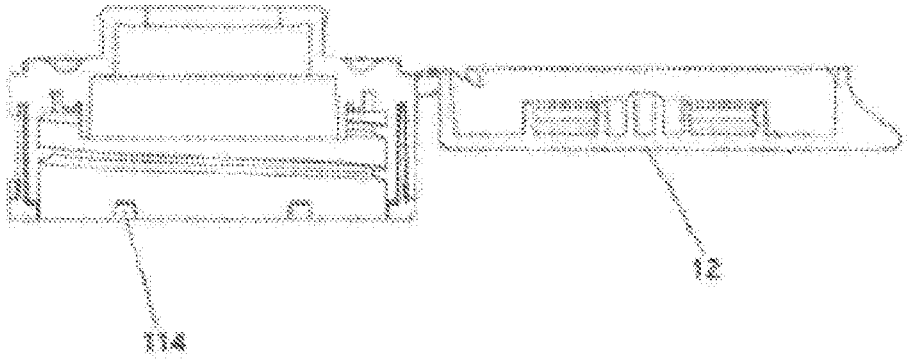
FIG. 3 is a schematic structural view of a sectional state of a bottle cap mechanism of the present invention.

Referring to FIGS. 1-3, a bottle cap mechanism 1 of the present invention includes a bottle cap body 11 and a label ring 13 which is inserted into the bottle cap body 11. The bottle cap body 11 includes an outer wall layer 112 and the inner wall layer 113 on the inner side of the outer wall layer 112, and the label ring 13 is snapped into the inner space formed by the outer wall layer 112 and the inner wall layer 113; There is one label through hole 111 for exposing label information.

In this application, the bottle cap main body 11 and the label ring 13 structure that is locked inside the bottle cap main body 11 are provided at the same time. The bottle cap main body 11 includes an outer wall layer 112 and an inner wall layer 113 located inside the outer wall layer 112. The tag ring 13 is snapped into the inner space formed by the outer wall layer 112 and the inner wall layer 113, and a tag is attached to the outer wall of the tag ring 13, because at least one of the outer wall layer 112 is provided to expose the tag information The label through hole 111 can achieve the effect of displaying label information. The structure design of the outer wall layer 112 and the inner wall layer 113 of this design is convenient for the snap-in of the label ring 13 and has a high degree of firmness, which is convenient for label replacement and the structural design reliability high.

In one preferred embodiment, a plurality of limiting grooves 114 are annularly formed on the bottom of the inner wall layer 113, and a plurality of limiting blocks 131 are integrally formed on the inner bottom of the label ring 13 to match the limiting grooves 114. When the label ring 13 is snapped into the inside of the cap body 11, the limiting block 131 is inserted into the corresponding limiting slot 114 for connection.

In another preferred embodiment, the inner space of the outer wall layer 112 and the inner wall layer 113 gradually decreases in width from the entrance to the inner space, and has a predetermined tapered structure. It is easy to snap in the label ring 13 and has better stability.

In another preferred embodiment, one end of the bottle cap body 11 is further connected with a bottle cap 12 that can be placed on the upper portion of the bottle cap body 11.

The description of above embodiments allows those skilled in the art to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. A bottle cap mechanism, wherein a bottle cap body and a label ring, wherein the bottle cap body further comprising an outer wall layer and an inner wall layer which is inside the outer wall layer, wherein the inner wall layer is concentrically fitted inside the outer wall layer, wherein an inner space is formed between the outer wall layer and the inner wall layer, wherein the label ring is inserted into the inner space and positioned concentrically between the outer layer wall and inner layer wall in the inner space, wherein at least one label through hole for exposing label information is positioned on the outer wall layer, wherein a plurality of limiting grooves are annularly formed on bottom of the inner wall layer, wherein a plurality of limiting blocks are annularly formed on bottom of the label ring and extend toward center of label ring, wherein each limiting groove corresponds to one of the limiting blocks.

2. The bottle cap mechanism according to claim 1, wherein the inner space formed between the outer wall layer and the inner wall layer gradually decreases in width and has a predetermined taper structure.

3. The bottle cap mechanism according to claim 1, wherein one end of the bottle cap body is further connected with a bottle cap on upper part of the bottle cap body.

4. The bottle cap mechanism according to claim 2, wherein one end of the bottle cap body is further connected with a bottle cap on upper part of the bottle cap body.

5. The bottle cap mechanism according to claim 3, wherein one end of the bottle cap body is further connected with the bottle cap on upper part of the bottle cap body.

6. The bottle cap mechanism according to claim 4, wherein a lip-shaped protrusion for opening the bottle cap is formed by extending an outer periphery of the bottle cap.

7. The bottle cap mechanism according to claim 1, wherein the bottom of the label ring and the bottom of the outer wall of the bottle cap body are flush with each other.

8. The bottle cap mechanism according to claim 4, a connected sealing ring is sleeved on the outside of the sealing column.

9. The bottle cap mechanism according to claim 1, wherein the at least one label through hole is elongated, and both sides of the label through hole are arc-shaped.

* * * * *